US005110700A

United States Patent [19]

Teuscher et al.

[11] Patent Number: 5,110,700

[45] Date of Patent: May 5, 1992

[54] ELECTROPHOTOGRAPHIC IMAGING MEMBER

[75] Inventors: Leon A. Teuscher; Satchidanand Mishra, both of Webster, N.Y.; Andrea G. Holland, Charlotte, N.C.

[73] Assignee: Xerox Corporation, Stamford, Conn.

[21] Appl. No.: 635,310

[22] Filed: Dec. 28, 1990

[51] Int. Cl.[5] ..... G03G 05/14; G03G 05/04

[52] U.S. Cl. ..... 430/64; 430/58; 430/62

[58] Field of Search ..... 430/64, 62, 58

[56] References Cited

U.S. PATENT DOCUMENTS

| | | | |
|---|---|---|---|
| 3,007,901 | 11/1961 | Minsk | 430/262 |
| 3,121,006 | 2/1964 | Middleton et al. . | |
| 3,357,989 | 12/1967 | Byrne et al. . | |
| 3,442,781 | 5/1969 | Weinberger . | |
| 3,656,949 | 4/1972 | Hanjo et al. | 430/62 |
| 3,745,005 | 7/1973 | Yoerger et al. | 430/64 |
| 3,887,369 | 6/1975 | Matsuno et al. . | |
| 4,082,551 | 4/1978 | Steklenski et al. . | |
| 4,233,384 | 11/1980 | Turner et al. . | |
| 4,265,990 | 5/1981 | Stolka et al. . | |
| 4,296,190 | 10/1981 | Hasegawa et al. . | |
| 4,299,897 | 11/1981 | Stolka et al. . | |
| 4,306,008 | 12/1981 | Pai et al. . | |
| 4,362,713 | 12/1982 | Buck | 526/240 |
| 4,439,507 | 3/1984 | Pan et al. . | |
| 4,571,371 | 2/1986 | Yashiki . | |
| 4,579,801 | 4/1986 | Yashiki . | |
| 4,664,995 | 5/1987 | Horgan et al. . | |

*Primary Examiner*—Marion E. McCamish
*Assistant Examiner*—C. D. RoDee
*Attorney, Agent, or Firm*—Oliff & Berridge

[57] ABSTRACT

An electrophotographic imaging member includes a blocking layer formed from a maleic acid half ester copolymer which has free acid groups neutralized by an alkali metal. The imaging member may be provided with a conductive layer formed from a phenolic resin and dispersed carbon black particles in an amount which allows sufficient transparency for rear erasure.

27 Claims, 1 Drawing Sheet

ELECTROPHOTOGRAPHIC IMAGING MEMBER

BACKGROUND OF THE INVENTION

The present invention relates to electrophotography, more specifically, to electrophotographic imaging members.

In electrophotography, an electrophotographic member containing a photoconductive insulating layer on a conductive layer is imaged by first uniformly electrostatically charging its surface. The member is then exposed to a pattern of activating electromagnetic radiation such as light. The radiation selectively dissipates the charge in the illuminated area of the photoconductive insulating layer while leaving behind an electrostatic latent image in the non-illuminated area. This electrostatic latent image may then be developed to form a visible image by depositing finely divided toner particles on the surface of the photoconductive insulating layer. The resulting visible image may then be transferred from the electrophotographic member to a support such as paper. This imaging process may be repeated many times with reusable photoconductive insulating layers.

An electrophotographic imaging member may be provided in a number of forms. For example, the imaging member may be a homogeneous layer of a single material or may be a composite layer containing a photoconductor and other material(s). A multilayered photoreceptor, for example, may comprise a substrate, a conductive layer, a blocking layer, an adhesive layer, a charge generating layer and a charge transport layer. Examples of photosensitive members having at least two electrically operative layers include a charge generator layer and a diamine containing transport layer as disclosed in U.S. Pat. Nos. 4,265,990; 4,233,384; 4,306,008; 4,299,897; and 4,439,507.

In multilayered imaging members, materials used for each layer preferably have desirable mechanical properties while also providing electrical properties necessary for the function of the device. If the material of one layer of the imaging device is changed in an attempt to improve a particular property, for example an electrical property, the change may have an adverse effect on mechanical properties, for example, such a change may lead to delamination. In the barrier (charge blocking) layer of multilayered imaging devices, it is desirable to provide a material which prevents charge injection while also preventing migration of materials, such as charge transport compounds, through the charge blocking layer.

Other difficulties exist in the fabrication of imaging members. For example, in seamless imaging members, a conductive metal layer cannot be deposited in an economic manner. Vacuum coating techniques are expensive when employing seamless substrates. Thus, the use of conductive layers applied by other coating techniques becomes important.

Recent work has indicated that seamless photoreceptors having conductive substrates of nylon with carbon black particles dispersed therein provide attractive properties. However, such photoreceptors may suffer from unsatisfactory adhesion and poor mechanical properties.

U.S. Pat. No. 3,887,369 to Matsuno et al discloses a barrier layer of copolymers comprising alkyl vinyl ethers and maleic anhydride, or composites of alkyl vinyl ethers/alkyl half esters of maleic acid copolymers and polyvinyl pyrrolidone or copolymers thereof.

U.S. Pat. No. 4,579,801 to Yashiki discloses an electro-photographic photosensitive member having a phenolic resin layer formed from a resol coat, between a substrate and a photosensitive layer. The phenolic resin layer may contain a dispersed electrically conductive material. Carbon is mentioned as an electrically conductive material.

U.S. Pat. No. 4,571,371 to Yashiki discloses an electrophotographic photosensitive member having an electroconductive layer between a substrate and a photosensitive layer. The electroconductive layer contains electroconductive material, a binder resin and a silicone compound leveling agent. Carbon powder is mentioned as an electroconductive material, and phenolic resin is mentioned as a binder resin. The silicone compound leveling agent allegedly improves the interfaces between the electroconductive layer and both the substrate and the photosensitive layer.

U.S. Pat. No. 4,296,190 to Hasegawa et al discloses an ionizing radiation curable resin such as non-modified maleic anhydride type unsaturated polyester, as an electrophotographic sensitive material. This material may be applied as a solution to a conductive substrate.

The above-described devices suffer from a number of disadvantages. For example, some electrophotographic imaging members suffer from poor charge acceptance and an excess of charge injections. In addition, charge transport materials from the photosensitive layer may diffuse and come in contact with the conductive layer, adversely affecting the photoreceptor. Additional problems of prior art imaging members include cycling up of electrical data during extended cycling in a scanner and excessive original residual voltage after erasing.

SUMMARY OF THE INVENTION

The present invention is directed to alleviating undesirable cycling up of electrical data during extended cycling in a scanner and to providing a materials combination having good adhesion between layers. It is an object of the invention to overcome the shortcomings of the prior art by providing an electrophotographic imaging member having a blocking layer which effectively blocks injection of positive charges, which improves charge acceptance and which prevents migration of charge transport compounds therethrough. It is a further object of the present invention to provide an electrophotographic imaging member which includes a layer which reduces cycling up and which decreases original residual voltage.

In accordance with one aspect of the present invention, there is provided a blocking layer comprising a neutralized maleic acid half ester copolymer, preferably a water- and alcohol-soluble inorganic salt of a maleic acid half ester copolymer, preferably attached to a substrate by an adhesive layer.

In accordance with another aspect of the present invention, there is provided an electrophotographic imaging member comprised of a conductive or nonconductive substrate, a conductive phenolic resin adhesive layer, and a blocking layer comprised of a neutralized maleic acid half ester copolymer. The imaging member also includes at least one photoconductive layer, preferably a charge generating layer and a charge transport layer, and is preferably substantially transparent to permit rear erasure.

The invention may be more fully understood with reference to the accompanying drawing and the following description of the embodiments shown in that drawing. The invention is not limited to the exemplary embodiments but should be recognized as contemplating all modifications within the skill of an ordinary artisan.

BRIEF DESCRIPTION OF THE DRAWING

A more complete understanding of the present invention can be obtained by reference to the accompanying FIG. 1 which is a cross-sectional view of an electrophotographic imaging member in accordance with the invention.

DESCRIPTION OF PREFERRED EMBODIMENTS

Figure 1:
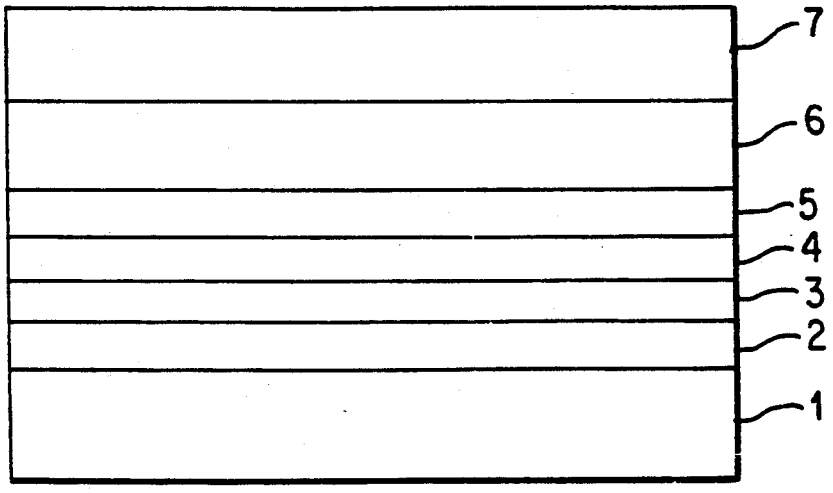

A representative structure of an electrophotographic imaging member of the invention is shown in FIG. 1. This imaging member includes a supporting substrate 1, an optional adhesive layer 2, a conductive layer 3, a blocking layer 4, an optional adhesive layer 5, a charge generating layer 6, and a charge transport layer 7. Other combinations of layers suitable for use in electrophotographic imaging members are within the scope of the invention.

The following is a description of layers which can be incorporated in electrophotographic imaging members according to the present invention.

The supporting substrate 1 may be opaque or substantially transparent and may comprise any of numerous suitable materials having acceptable mechanical properties. The substrate may be provided with an electrically conductive surface. As electrically non-conducting materials, there may be employed any of various resins, including polyesters, polycarbonates, polyamides, polyurethanes, and the like. The substrate may comprise a commercially available biaxially oriented polyester known as Mylar, available from E. I. du Pont de Nemours & Co., or Melinex available from ICI Americas Inc. Electrically non-conducting materials may be made conductive by dispersing electrically conductive powders in the resins. Electrically conductive powders for dispersion include, for example, carbon black, metal powders, ionic organic conductive particles, conductive inorganic particles, $SnO_2$ doped with antimony or indium, conductive zinc oxide, and the like. Alternatively, or in addition, a conductive layer such as a conductive metal layer may be formed on the substrate. Examples of conductive metals include aluminum, zirconium, niobium, tantalum, vanadium, hafnium, titanium, nickel, stainless steel, chromium, tungsten, molybdenum, brass, gold, and the like, and mixtures thereof. The substrate may be flexible or rigid and may have any number of different configurations such as, for example, a sheet, a scroll, an endless flexible belt, a drum, and the like. Preferably, the substrate is in the form of an endless flexible belt.

In one embodiment of the invention, the substrate 1 comprises nylon, or nylon with carbon black dispersed therein. A substrate of nylon having dispersed carbon black provides conductivity for the electrophotographic imaging member and provides better adhesion when overcoated with a blocking layer in accordance with the present invention. A conductive substrate can provide the necessary grounding for the device and eliminate the need for a ground strip. The carbon black loading of the substrate may range from about 10% to about 35% by weight based on the total weight of the substrate layer. At loadings below about 10%, conductivity tends to be adversely affected and at loadings exceeding about 35%, cracking problems tend to occur. Loss of flexibility also tends to occur at such loadings if the substrate is provided in a belt form. A preferred loading range is from about 10% to about 30% by weight, more preferably from about 13% to about 17% by weight, based on the total weight of the layer.

The choice of the thickness for the substrate layer depends on numerous factors, including economic considerations. If the substrate is to be used in a flexible belt, the thickness of the substrate layer may be selected from within the range of from about 1 mil to about 10 mils and preferably from about 3 mils to about 5 mils for optimum flexibility and minimum induced surface bending stress when cycled around small diameter rollers, e.g., 19 millimeter diameter rollers. The substrate for a flexible belt or rigid drum may be of substantial thickness, provided there are no adverse effects on the final photoconductive device. A surface resistivity of less than about $10^6$ ohm-cm is preferred.

In the case of a flexible nylon or a rigid nylon substrate, a conductive layer 3 comprising a phenolic resin improves adhesion between the substrate 1 and the blocking layer 4. Phenolic resins provide good adhesive and mechanical properties. Advantageously, carbon black can be provided in the phenolic resin to render it conductive. The phenolic layer preferably has carbon black dispersed therein in an amount of from about 10 to about 30% by weight, and more preferably from about 13 to about 17% by weight. The dispersion of carbon black in the phenolic resin allows the layer to become conductive. Further, at loadings preferably between about 13% to about 17% by weight of carbon black, the phenolic layer is sufficiently transparent and conductive so that rear erasure may be performed. The layer 3 may be formed on the substrate 1 by any suitable coating technique, such as spraying, dip coating, draw bar coating, gravure coating, silk screening, air knife coating, reverse roll coating, chemical treatment and the like. This layer is preferably applied using a solvent, such as THF (tetrahydrofuran), methyl ethyl ketone, methyl propylene glycols and esters thereof, methylene chloride, and the like. Layer 3 may be of a thickness within a wide range, depending on the optical transparency and flexibility desired for the electrophotoconductive member. Accordingly, for a flexible photoresponsive imaging device, the thickness of the phenolic layer is within the range of from about 0.5 micron to about 50 microns, preferably from about 1 micron to about 3 microns. Phenolic layers according to the present invention are effective to reduce cycling up of electrical data during extended cycling and decrease original residual voltage after erasing.

An optional adhesive layer 2 may be present between the supporting substrate and the conductive layer 3 to promote adhesion. The adhesive layer is not necessary when certain combinations of layers are used. For example, good adhesion is provided between a nylon substrate and a conductive layer of phenolic resin. Also, the adhesive layer is more likely to be used with flexible belts than when a rigid drum is used, since flexible belts require greater adhesion between layers to prevent delamination.

For negatively charged photoreceptors, the blocking layer must be capable of preventing hole injection from the conductive layer to the photoconductive layer. The blocking layer 4 of the invention preferably comprises a water- and alcohol-soluble copolymer salt of a maleic acid half ester. The salt is preferably an alkali metal salt. A "half ester" copolymer as employed herein is defined as a compound having a backbone chain of repeating hydrocarbon units and groups as pendant side chains chemically bonded to the backbone chain, half of the pendant side chains terminating with —COOH or —COOM (wherein M is a metal) and the other half terminating with an ester group.

The half ester copolymers are fully soluble in alcohol solvents and are not soluble in other organic solvents such as diethyl ether, hexane and toluene. Thus, the deposited coatings are not affected by some of the organic solvents commonly employed to deposit subsequent layers and white spots are prevented. Unfortunately, blocking layers containing the half ester copolymer by itself cause cycling down of the photoreceptor. However, the addition of an alkali metal to the half ester composition prevents cycling down by neutralizing a number of the available free acid groups. The available free acid of the half ester can be neutralized from about 5% to about 100% mole, preferably from 20% mole to about 75% mole. The remaining unneutralized free acid groups are preferred for adhesion to adjacent layers through cross-linking.

While not wishing to be bound by any theory, it is believed that the maleic acid half ester which is neutralized is effective in preventing charge injection. The maleic acid half ester can be obtained from a copolymer of maleic anhydride and another monomer. The other monomer is preferably selected so as to provide increased solubility of the copolymer as well as film-forming capability. For example, ethylene, methyl vinyl ether, and/or butyl vinyl ether may be used as a copolymer with maleic anhydride.

For example, the half ester may be represented as follows:

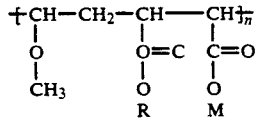

where M is a metal, for example, lithium, sodium, potassium and the like, and R is an alkyl group, for example, methyl, ethyl, butyl, and the like, and n may be from about 10 to about 2,000. The half ester is obtained by reacting a maleic anhydride copolymer with an alcohol. Maleic anhydride copolymers are commercially available as Gantrez AN 119, Gantrez AN 149, Gantrez AN 169, Gantrez and Gantrez AN 179, from General Aniline and Film Corporation (GAF). Copolymers of ethylene and maleic anhydride are available from Monsanto under the trade name EMA.

It is theorized that alkali metals neutralize the acid groups of the copolymer. Monovalent alkali metals, for example, sodium, lithium, potassium, rubidium, cesium, and the like, are preferred in accordance with the present invention. Sodium and lithium are most preferred.

In forming the maleic acid half ester copolymer salt of the invention, copolymer according to the above description may be dissolved in a solution of methyl alcohol, ethyl alcohol, water, mixtures thereof, and the like. A solution of an alkali metal hydroxide, for example, sodium hydroxide or lithium hydroxide, may be added in a solution of methyl alcohol or ethyl alcohol to the copolymer solution. The copolymer acts as an acid and the alkali metal hydroxide acts as a base, thereby forming a copolymer salt.

Compositions containing the half ester copolymer neutralized by alkali metal can be readily deposited as a coating from alcohol solutions to prevent cycling down and white spots. Moreover, half ester copolymers are less sensitive to humidity and delamination problems. Because the neutralized half ester copolymer preferably has free acid moieties that can cross-link with polyols such as glycerol when heated to temperatures greater than about 100° C., the coating becomes insoluble in most organic solvents contained in subsequently applied coatings because the half ester coating composition is cross-linked upon heating. Delamination under humid conditions is also prevented by cross-linking. Typical polyols include glycerol, ethylene glycol, diethylene glycol, triethanol amine, and the like, and mixtures thereof. Generally, a mole ratio of 1 mole of copolymer to 0.15 to 0.03 moles of polyol is satisfactory.

The blocking layer is preferably continuous and has a thickness of about 0.01 micrometer to about 1 micrometer. Greater thicknesses tend to lead to undesirably high residual voltage. A barrier layer thickness between about 0.05 micrometer and about 0.5 micrometer is preferred to facilitate charge neutralization after the exposure step and to achieve optimum electrical performance.

The blocking layer may be applied by any suitable technique such as spraying, dip coating, draw bar coating, gravure coating, silk screening, air knife coating, reverse roll coating, and the like. For convenience in obtaining thin layers, the blocking layer is preferably applied in the form of a dilute solution with ethyl or methyl alcohol being removed after deposition of the coating by techniques such as applying vacuum, heating and the like.

The blocking layer solution may be applied to the phenolic layer and heated to obtain cross-linking esters between the phenolic layer and the barrier layer, e.g., between the maleic free acid groups and the free hydroxy groups of the phenolic resin. Sufficient cross-linking can occur by heating at about 60° C. to about 120° C. for about one minute to about 24 hours, preferably about 10 minutes to about one hour at 100° C. and about 10 minutes to about one hour at 120° C. Therefore, superior bonding between the layers is provided. The drying temperature may be maintained by any suitable technique such as ovens, forced air ovens, radiant heat lamps, and the like. The drying time depends upon the temperatures used. Thus less time is required when higher temperatures are employed. Generally, increasing the time increases the amount of solvent removed. One may readily determine whether sufficient drying has occurred by chromatographic or gravimetric analysis. Coating compositions containing the half ester become insoluble in the solvent that is employed to apply the coating. This insolubility is the result of cross-linking and is important because the solvent of the subsequently applied coating solutions may adversely affect the blocking layer if the blocking layer were soluble in such solvents.

The charge blocking effects of blocking layers according to the present invention are substantially independent of thickness, so that there is no substantial increase of residual potential after erasing exposure.

An optional adhesive layer 5 may be provided between the blocking layer 4 and the charge generating layer 6 to improve adhesion between the layers. Any suitable adhesive material be employed for the optional adhesive layers 2 and 5. Adhesive layers preferably have a dry thickness between about 0.001 micrometer to about 0.2 micrometer. Typical adhesive layers include film-forming polymers such as polyester (e.g., 49,000 resin available from E. I. du Pont de Nemours & Co.; Vitel PE-100 and Vitel PE-200 resins available from Goodyear Rubber & Tire Co.), polyvinylbutyral, polyvinylpyrrolidone, polyurethane, polymethyl methacrylate, 4-vinylpridine, and the like.

Du Pont 49,000 is a linear saturated copolyester of four diacids and ethylene glycol having a molecular weight of about 70,000. Its molecular structure is represented as $$HO-\overset{O}{\overset{\|}{C}}\text{-[Diacid-Ethylene glycol]}_n OH$$

The ratio of diacid to ethylene glycol in the copolyester is 1:1.

The diacids are terephthalic acid, isophthalic acid, adipic acid and azelaic acid in a ratio of 4:4:1:1.

Vitel PE-100 is a linear copolyester of two diacids and ethylene glycol having a molecular weight of about 50,000. Its molecular structure is represented as $$HO-\overset{O}{\overset{\|}{C}}\text{-[Diacid-Ethylene glycol]}_n OH$$

The ratio of diacid to ethylene glycol in the copolyester is 1:1.

The two diacids are terephthalic acid and isophthalic acid in a ratio of 3:2.

Vitel PE-200 is a linear saturated copolyester of two diacids and two diols having a molecular weight of about 45,000. The molecular structure is represented as $$HO-\overset{O}{\overset{\|}{C}}\text{-[Diacid-Diol]}_n OH$$

The ratio of diacid to diol in the copolyester is 1:1. The two diacids are terephthalic and isophthalic acid in a ratio of 1.2:1. The two diols are ethylene glycol and 2,2-dimethyl propane diol in a ratio of 1.33:1.

The adhesive layers may be applied with a suitable liquid carrier. Typical liquid carriers include methylene chloride, alcohol, THF, ketones, esters, hydrocarbons and the like.

Any suitable charge generating (photogenerating) layer 6 may be applied to the adhesive layer 5 (if employed) or the blocking layer 4. Examples of materials for photogenerating layers include inorganic photoconductive particles such as amorphous selenium, trigonal selenium, and selenium alloys selected from the group consisting of selenium-tellurium, selenium-tellurium-arsenic, selenium arsenide and phthalocyanine pigment such as the X-form of metal free phthalocyanine described in U.S. Pat. No. 3,357,989, metal phthalocyanines such as vanadyl phthalocyanine, titanyl phthalocyanine and copper phthalocyanine, dibromoanthanthrone, squarylium, quinacridones available from du Pont under the tradename Monastral Red, Monastral Violet and Monastral Red Y, Vat orange 1 and Vat orange 3 (trade names for dibromo anthanthrone pigments), benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like, dispersed in a film forming polymeric binder. Other suitable photogenerating materials known in the art may also be utilized, if desired. Charge generating layers comprising a photoconductive material such as amorphous silicon, microcrystalline silica, vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof, are especially preferred because of their sensitivity to white light. Vanadyl phthalocyanine, metal free phthalocyanine and selenium alloys are also preferred because these materials provide the additional benefit of being sensitive to infrared light.

Any suitable polymeric film forming binder material may be employed as the matrix in the photogenerating binder layer. Typical polymeric film forming materials include those described, for example, in U.S. Pat. No. 3,121,006. The binder polymer should adhere well to the adhesive layer, dissolve in a solvent which also dissolves the upper surface of the adhesive layer and be miscible with the copolyester of the adhesive layer to form a polymer blend zone. Typical solvents include monochlorobenzene, tetrahydrofuran, cyclohexanone, methylene chloride, 1,1,1-trichloroethane, 1,1,2-trichloroethane, dichloroethylene, toluene, and the like, and mixtures thereof. Mixtures of solvents may be utilized to control evaporation range. For example, satisfactory results may be achieved with a tetrahydrofuran to toluene ratio of between about 90:10 and about 10:90 by weight. Generally, the combination of photogenerating pigment, binder polymer and solvent should form uniform dispersions of the photogenerating pigment in the charge generating layer coating composition. Typical combinations include polyvinylcarbazole, trigonal selenium and tetrahydrofuran; phenoxy resin, trigonal selenium and toluene; and polycarbonate resin, vanadyl phthalocyanine and methylene chloride. The solvent for the charge generating layer binder polymer should dissolve the polymer binder utilized in the charge generating layer and be capable of dispersing the photogenerating pigment particles present in the charge generating layer.

The photogenerating composition or pigment in the resinous binder composition can be provided in various amounts. Generally, from about 5 percent by volume to about 90 percent by volume of the photogenerating pigment is dispersed in about 95 to about 10 percent by volume of the resinous binder. In one embodiment, about 8 percent by volume of the photogenerating pigment is dispersed in about 92 percent by volume of the resinous binder composition. In another embodiment about 90% of the photogenerating pigment is dispersed in about 10% binder.

The photogenerating layer containing photoconductive compositions and/or pigments and the resinous binder material generally ranges in thickness from about 0.1 micrometer to about 5.0 micrometers, and preferably has a thickness from about 0.3 micrometer to about 3 micrometers. The photogenerating layer thickness generally depends on pigment content. Higher binder content compositions generally require thicker layers for photogeneration. Thicknesses outside these ranges can be selected provided the objectives of the present invention are achieved. Any suitable technique may be utilized to mix and thereafter apply the photogenerating layer coating mixture to the previously dried adhesive layer. Typical application techniques include spraying, dip coating, roll coating, wire wound rod coating, and the like. Drying of the deposited coating may be effected by any suitable conventional technique such as oven drying, infrared radiation drying, air drying and the like, to remove substantially all of the solvents utilized in applying the coating.

The active charge transport layer 7 may comprise any suitable transparent organic polymer or non-polymeric material capable of supporting the injection of photogenerated holes and/or electrons from the charge generating layer and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Angstroms to 9000 Angstroms. Therefore, the charge transport layer is substantially transparent to radiation in a region in which the photoconductor is to be used. Thus, the active charge transport layer is a material which supports the injection of photogenerated holes or electrons from the charge generating layer. The active charge transport layer is normally transparent when exposure is effected therethrough to ensure that most of the incident radiation is utilized by the underlying charge generating layer for efficient photogeneration. When used with a transparent substrate, imagewise exposure or erasure may be accomplished through the substrate with all light passing through the substrate. In this case, the active transport material need not be transmitting in the wavelength region of use. The charge transport layer in conjunction with the charge generating layer is insulative to the extent that an electrostatic charge placed on the charge transport layer is not conducted in the absence of illumination.

The active charge transport layer may comprise an activating compound useful as an additive dispersed in electrically inactive polymeric materials, making these materials electrically active. These compounds may be added to polymeric materials which are incapable of supporting the injection of photogenerated holes from the charge generating layer and incapable of allowing transport of these holes. This will convert the electrically inactive polymeric material to a material capable of supporting the injection of photogenerated holes from the charge generating layer and capable of allowing the transport of these holes through the active charge transport layer in order to discharge the surface charge on the active charge transport layer. An especially preferred charge transport layer employed in multilayer photoconductors comprises from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture preferably comprises a charge transport material comprising an aromatic amine compound of one or more compounds having the formula:

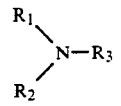

wherein $R_1$ and $R_2$ are each an aromatic group selected from the group consisting of a substituted or unsubstituted phenyl group, naphthyl group, and polyphenyl group and $R_3$ is selected from the group consisting of a substituted or unsubstituted aryl group, alkyl groups having from 1 to 18 carbon atoms and cycloaliphatic groups having from 3 to 18 carbon atoms. The charge transport layer forming mixture preferably comprises a charge transport material comprising a tri-aryl amine, i.e., in which $R_1$, $R_2$ and $R_3$ all represent aryl groups. The substitutents ($R_1$–$R_3$) should be free from electron withdrawing groups such as $NO_2$ groups, CN groups, and the like. Typical aromatic amine compounds that are represented by this structural formula include:

I. Triphenyl amines such as:

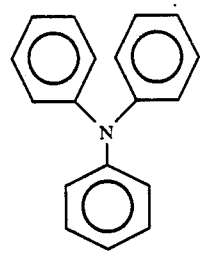

II. Bis and poly triarylamines such as:

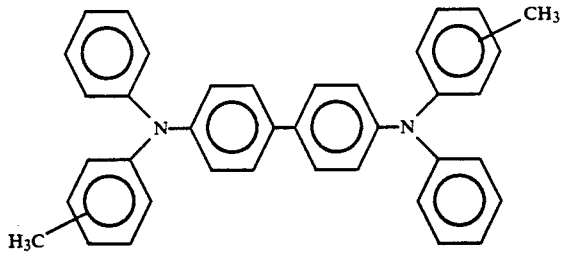

III. Bis arylamine ethers such as:

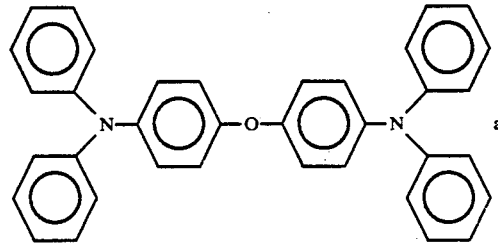

and

IV. Bis alkyl-arylamines such as:

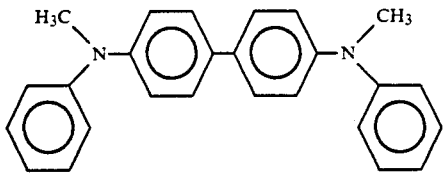

Preferred aromatic amine compounds are of the formula:

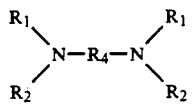

wherein $R_1$ and $R_2$ are as defined above, and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free from electron withdrawing groups such as $NO_2$ groups, CN groups, and the like.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4''-bis(diethylamino)-2',2''-dimethyltriphenylmethane; N,N'-bis(alkylphenyl)-(1,1'-biphenyl)-4,4'-diamine wherein the alkyl is, for example, methyl, ethyl, propyl, n-butyl, etc., N,N'-diphenyl-N,N'-bis(3''-methylphenyl)-(1,1'-biphenyl)-4,4'-diamine, and the like, dispersed in an inactive resin binder.

Any suitable inactive resin binder soluble in methylene chloride or other suitable solvent may be employed. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these binders include monochlorobenzene, tetrahydrofuran, toluene, dichloroethylene, 1,1,2-trichloroethane, 1,1,1-trichloroethane, and the like.

The preferred electrically inactive resin materials are polycarbonate resins having molecular weight from about 20,000 to about 120,000, more preferably from about 50,000 to about 100,000. The materials most preferred as the electrically inactive resin material are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; a polycarbonate resin having a molecular weight of from about 50,000 to about 100,000, available as Makrolon from Farben Fabricken Bayer A. G.; a polycarbonate resin having a molecular weight of from about 20,000 to about 50,000 available as Merlon from Mobay Chemical Company; polyether carbonates; and 4,4'-cyclohexylidene diphenyl polycarbonate. Methylene chloride solvent is a desirable component of the charge transport layer coating mixture for adequate dissolving of all the components and for its low boiling point.

An especially preferred multilayered photoconductor comprises a charge generating layer comprising a binder layer of photoconductive material and a contiguous hole transport layer of a polycarbonate resin material having a molecular weight of from about 20,000 to about 120,000 having dispersed therein from about 25 to about 75 percent by weight of one or more compounds having the formula:

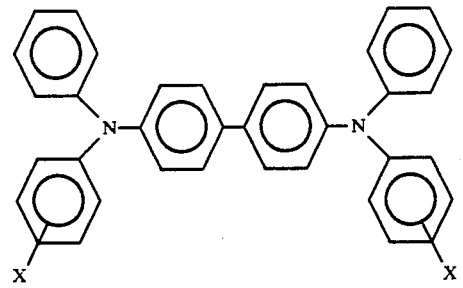

wherein X is selected from the group consisting of an alkyl group having from 1 to about 4 carbon atoms and chlorine, the photoconductive layer exhibiting the capability of photogeneration of holes and injection of the holes, the hole transport layer being substantially nonabsorbing in the spectral region at which the photoconductive layer generates and injects photogenerated holes but being capable of supporting the injection of photogenerated holes from the photoconductive layer and transporting the holes through the hole transport layer.

A ground strip (not shown) may be provided adjacent the charge transport layer at an outer edge of the imaging member. See U.S. Pat. No. 4,664,995. The ground strip is coated adjacent to the charge transport layer so as to provide grounding contact with a grounding device (not shown).

The invention will further be illustrated in the following examples, it being understood that these examples are illustrative only and that the invention is not limited to the materials, conditions, process parameters and the like recited herein.

COMPARATIVE EXAMPLE 1

An adhesive layer is prepared from a solution of ½% polyester (Dupont 49,000) in THF/cyclohexanone and coated with a ½ mil gap Bird bar upon a 3 mil polyester (Mylar) film. This coated film is forced air dried for 1 hour at 100° C. A slurry of electrically conductive carbon black Black Pearle 2000 (Cabot) and Varcum 29-112 (Reichhold) in a ratio of 20/80 in THF/cyclohexanone 50:50 is prepared by ball milling. This slurry is coated upon the 49,000 coated Mylar with a ½ mil gap Bird bar and dried for 1 hour at 100° C. in a forced air oven. This forms the conductive layer for the photoreceptor. An adhesive layer of ½% 49,000 solution as previously described is coated upon the electrically conductive carbon black layer and dried in a forced air oven for 1 hour at 100° C. A charge generating layer of selenium/PVK (10% by volume in 50:50 THF/TOL solution) is coated on the adhesive layer with a ½ mil Bird bar and dried at 125° C. for 30 minutes. A charge transport layer is coated on the top of the charge generating layer by a 4.5 mil Bird bar. The layer is coated from a weight ratio of 1:1 N,N'-diphenyl-N,N'-bis(3-methylphenyl)-1-1'-biphenyl-4,4'-diamine and Makrolon solution in methylene chloride (15% solid). This is dried at 80° C. for 15 minutes and then at 125° C. for 15 minutes.

The xerographic cyclic testing of the device shows unacceptable charge acceptance. The adhesion between the adhesive layer and the generator layer is measured to be 10 to 15 grams in a reverse peel experiment with an Instron Tensile Tester.

Electrical characteristics are reported in Table 1 below.

EXAMPLE 2

A 5% alcohol solution of Gantrez 169 (GAF) is refluxed under stirring for 24 hours to yield the half ester. The viscosity of the solution increases as the reaction proceeds. To this solution, a solution of lithium hydroxide in alcohol is added to neutralize stoichiometrically ½ of the acid groups of the half esters. After the neutralization, the solution is reduced to 0.5% solid and is coated between the conductive layer and the adhesive layer of Example 1.

The electrical cyclic testing in a scanner shows the device to be acceptable with good charge acceptance. See Table 1 for the electrical characteristics. The adhesion between the adhesive layer and the generator layer of the total device is also found to be acceptable (10 to 15 grams) for designing a photoreceptor for high volume copiers. The sheet resistivity is $8\times10^3$ ohms/sq and the light transmission is 1.6%.

EXAMPLE 3

The same fabrication procedures are followed as in Example 2 but with 25% carbon loading in the conductive layer. The sheet resistivity of this conductive layer is $2.5\times10^3$ ohms/sq and the light transmission of the layer is less than 1%.

EXAMPLE 4

The same procedures are followed as in Example 2 but with 17% carbon loading in the conductive layer. The sheet resistivity of this conductive layer is $2.5\times10^4$ ohms/sq and the light transmission is 2%.

EXAMPLE 5

The same procedures are followed as in Example 2 but with 15% carbon loading in the conductive layer. The sheet resistivity of this conductive layer is $8\times10^4$ ohms/sq and the light transmission is 5%.

EXAMPLE 6

The same procedures are followed as in Example 2 but with 10% carbon loading in the conductive layer. The sheet resistivity of this conductive layer is $7\times10^7$ ohms/sq and the light transmission is 17%.

EXAMPLE 7

The same procedures are followed as in Example 2 but the lithium hydroxide is replaced by sodium hydroxide. Electrical characteristics are good, and are shown in Table 2.

COMPARATIVE EXAMPLE 8

The same procedures are followed as in Example 2, except that no lithium hydroxide is used. The half ester/acid is used as is. The electrical properties show good charge acceptance but higher dark decay and poor cyclic instability in a 10,000 cycle test. Electrical characteristics are reported in Table 2.

EXAMPLE 9

The same procedures are followed as in Example 2, except that 0.1% of ethylene diglycol is added to the half ester solutions. The ethylene diglycol is used as a cross-linking agent during the drying period. The diglycol helps the adhesion at higher humidity. The electrical cyclic instability is found to be acceptable.

EXAMPLE 10

The same procedures are followed as in Example 2 with the exception that a nylon tube is used in place of the Mylar substrate, and no adhesive layer is applied to the nylon tube. Instead, the conductive layer is coated directly on the nylon tube. Acceptable electrical results are obtained.

EXAMPLE 11

The same procedures are followed as in Example 10, except that 20% conductive carbon black is added to the nylon. This device is used without a separate grounding strip. The tube is grounded with the help of a mounting fixture similar to a metallic drum used in alloy grounded photoreceptors. Acceptable electrical results are obtained.

TABLE 1

| ELECTRICAL CHARACTERISTICS | NO BARRIER LAYER COMPARATIVE EXAMPLE 1 | WITH BARRIER LAYER (GANTREZ WITH LITHIUM HYDROXIDE) EXAMPLE 2 |
|---|---|---|
| CHARGE ACCEPTANCE | 400 VOLTS | 880 VOLTS |
| DARK DECAY/ SEC | 200 VOLTS | 80 VOLTS |
| 1 LIGHT FLASH 5 ERGS | FROM 220 VOLTS TO 120 VOLTS | FROM 800 VOLTS TO 120 VOLTS |
| LIGHT ERASE 300 ERGS | 5 VOLTS | 10 VOLTS |

TABLE 2

| ELECTRICAL CHARACTERISTICS | WITH BARRIER LAYER (GANTREZ ONLY) COMPARATIVE EXAMPLE 8 | WITH BARRIER LAYER (GANTREZ WITH SODIUM HYDROXIDE) EXAMPLE 7 |
|---|---|---|
| CHARGE ACCEPTANCE | 750 VOLTS | 880 VOLTS |

TABLE 2-continued

| ELECTRICAL CHARACTERISTICS | WITH BARRIER LAYER (GANTREZ ONLY) COMPARATIVE EXAMPLE 8 | WITH BARRIER LAYER (GANTREZ WITH SODIUM HYDROXIDE) EXAMPLE 7 |
|---|---|---|
| DARK DECAY/ SEC | 250 VOLTS | 90 VOLTS |
| 1 LIGHT FLASH 5 ERGS | FROM 500 VOLTS TO 120 VOLTS | FROM 790 VOLTS TO 120 VOLTS |
| LIGHT ERASE 300 ERGS | 10 VOLTS | 10 VOLTS |

While the invention has been described with reference to particular preferred embodiments, the invention is not limited to the specific examples given, and other embodiments and modifications can be made by those skilled in the art without departing from the spirit and scope of the invention.

What is claimed:

1. An electrophotographic imaging member, comprising at least one photoconductive layer and a blocking layer comprised of an alkali metal salt of a maleic acid half ester copolymer, wherein at least a portion of free acid groups in said copolymer is neutralized by an alkali metal.

2. The imaging member of claim 1, wherein the alkali metal is selected from the group consisting of sodium, lithium and potassium.

3. The imaging member of claim 1, wherein about 5% mole to about 100% mole of said free acid groups are neutralized.

4. The imaging member of claim 3, further comprising a cross-linking agent, less than 100% mole of said free acid groups in the blocking layer being neutralized.

5. The imaging member of claim 4, wherein said cross-linking agent is a polyol.

6. The imaging member of claim 1, wherein about 20% mole to about 75% mole of said free acid groups are neutralized.

7. An electrophotographic imaging member, comprising at least one photoconductive layer, a substrate, a blocking layer comprised of an alkali metal salt of a maleic acid half ester copolymer in which at least a portion of free acid groups is neutralized, and a conductive layer between said substrate and said blocking layer.

8. The imaging member of claim 7, wherein said conductive layer comprises phenolic resin.

9. The imaging member of claim 8, wherein said conductive layer further comprises dispersed conductive particles of carbon black.

10. The imaging member of claim 9, wherein from about 10% to about 30% by weight of carbon black is dispersed in said phenolic resin.

11. The imaging member of claim 9, wherein from about 13% to about 17% by weight of carbon black is dispersed in said phenolic resin.

12. The imaging member of claim 9, wherein said substrate comprises nylon.

13. The imaging member of claim 8, wherein said substrate comprises nylon and dispersed conductive particles of carbon black.

14. The imaging member of claim 8, wherein said substrate comprises dispersed conductive particles.

15. The imaging member of claim 7, further comprising an adhesive layer between said conductive layer and said substrate.

16. The imaging member of claim 7, wherein said layers are substantially transparent.

17. An electrophotographic imaging member, comprising:

a substrate;

a conductive layer comprising a phenolic resin;

a blocking layer comprising a maleic acid half ester copolymer having at least a portion of its free acid groups neutralized with an alkali metal;

a charge generating layer; and a charge transport layer.

18. The imaging member of claim 17, wherein said substrate comprises nylon.

19. The imaging member of claim 17, further comprising an adhesive layer between the substrate and the conductive layer.

20. The imaging member of claim 17, wherein the conductive layer further comprises carbon black.

21. The imaging member of claim 17, wherein from about 10% to about 30% by weight of carbon black is dispersed in said conductive layer.

22. The imaging member of claim 17, wherein from about 13% to about 17% by weight of carbon black is dispersed in said conductive layer.

23. The imaging member of claim 17, wherein said substrate comprises nylon.

24. The imaging member of claim 17, wherein conductive particles are dispersed in said substrate.

25. The imaging member of claim 17, wherein about 5% mole to about 100% mole of said free acid groups are neutralized by said alkali metal.

26. The imaging member of claim 17, wherein about 20% mole to about 75% mole of said free acid groups are neutralized by said alkali metal.

27. The imaging member of claim 17, wherein said layers are substantially transparent.

* * * * *